US006040280A

United States Patent [19]

Kelly et al.

[11] Patent Number: 6,040,280

[45] Date of Patent: Mar. 21, 2000

[54] LUBRICANT AND SURFACE CONDITIONER SUITABLE FOR CONVERSION COATED METAL SURFACES

[75] Inventors: Timm L. Kelly, Birmingham; Gary L. Rochfort, Shelby Township, both of Mich.

[73] Assignee: Henkel Corporation, Gulph Mills, Pa.

[21] Appl. No.: 09/077,592

[22] PCT Filed: Nov. 27, 1996

[86] PCT No.: PCT/US96/18554

§ 371 Date: Jun. 1, 1998

§ 102(e) Date: Jun. 1, 1998

[87] PCT Pub. No.: WO97/20903

PCT Pub. Date: Jun. 12, 1997

Related U.S. Application Data

[60] Provisional application No. 60/007,853, Dec. 1, 1995.

[51] Int. Cl.[7] ..... C10M 173/02

[52] U.S. Cl. ..... 508/503; 508/517; 508/532

[58] Field of Search ..... 508/503, 517, 508/532; 72/42

[56] References Cited

U.S. PATENT DOCUMENTS

| | | | |
|---|---|---|---|
| 3,431,182 | 3/1969 | Frant | 204/1 |
| 3,964,389 | 6/1976 | Peterson | 101/467 |
| 4,148,670 | 4/1979 | Kelly | 148/6.15 R |
| 4,273,592 | 6/1981 | Kelly | 148/6.27 |
| 4,313,769 | 2/1982 | Frelin et al. | 148/6.27 |
| 4,370,177 | 1/1983 | Frelin et al. | 148/6.27 |
| 4,859,351 | 8/1989 | Awad | 252/32.5 |
| 4,921,552 | 5/1990 | Sander et al. . | |
| 4,944,889 | 7/1990 | Awad | 252/32.5 |
| 4,992,115 | 2/1991 | Ikeda | 148/247 |
| 5,030,323 | 7/1991 | Awad | 156/665 |
| 5,061,389 | 10/1991 | Reichgott | 252/49.3 |
| 5,064,500 | 11/1991 | Awad | 156/665 |
| 5,139,586 | 8/1992 | Das | 148/246 |
| 5,236,519 | 8/1993 | Nakano et al. | 148/246 |
| 5,279,677 | 1/1994 | Das | 134/3 |
| 5,332,452 | 7/1994 | Das | 148/247 |
| 5,370,909 | 12/1994 | Tanaka et al. | 427/388.4 |
| 5,378,379 | 1/1995 | Bershas | 252/49.3 |

OTHER PUBLICATIONS

Henkel Surface Technologies Technical Process Bulletin No. 968—dated Apr. 19, 1989.

Henkel Surface Technologies Technical Process Bulletin No. 1580—dated Jan. 3, 1994.

*Primary Examiner*—Margaret Medley

*Attorney, Agent, or Firm*—Ernest G. Szoke; Wayne C. Jaeschke; Norvell E. Wisdom, Jr.

[57] ABSTRACT

An excellent lubricant and surface conditioner layer on formed metal surfaces, particularly aluminum cans that have been previously provided with a chromium oxide conversion coating, can be formed by contacting the cans with an aqueous lubricant and surface conditioner forming composition that contains at least one oxa acid or methyl ester thereof corresponding to general formula (I):

$$CH_3(CH_2)_aO(CH_2CH_2O)_xCH_2C(O)OR \quad (I),$$

where each of n and x, which may be the same or different, is a positive integer and R represents H or $CH_3$ and at least 20 weight % of the total content corresponding to general formula (I) does so when x is at least 8, and then drying the thus-treated cans.

20 Claims, No Drawings

LUBRICANT AND SURFACE CONDITIONER SUITABLE FOR CONVERSION COATED METAL SURFACES

This application is a 371 continuation of PCT International Application No. PCT/US96/18554 filed on Nov. 27, 1996. This application claims benefit of provisional application 60/007853, filed Dec. 1, 1995.

BACKGROUND OF THE INVENTION

1. Field of the Invention

This invention relates to improvements in processes and compositions which accomplish at least one, and most preferably all, of the following related objectives when applied to formed metal surfaces, more particularly to the surfaces of cleaned and conversion coated aluminum and/or tin plated cans: (i) reducing the coefficient of static friction of the treated surfaces after drying of such surfaces, without adversely affecting the adhesion of paints or lacquers applied thereto; (ii) promoting the drainage of water from treated surfaces; and (iii) lowering the dryoff oven temperature required for drying said surfaces after they have been rinsed with water.

2. Discussion of Related Art

The following discussion and the description of the invention will be set forth primarily for aluminum cans, as these represent the largest volume area of application of the invention. However, it is to be understood that, with the obviously necessary modifications, both the discussion and the description of the invention apply also to tin plated steel cans and to other types of formed metal surfaces for which any of the above stated intended purposes of the invention is practically interesting.

Aluminum cans are commonly used as containers for a wide variety of products. After their manufacture, the aluminum cans are typically washed with acidic cleaners to remove aluminum fines and other contaminants therefrom. Recently, environmental considerations and the possibility that residues remaining on the cans following acidic cleaning could influence the flavor of beverages packaged in the cans have led to an interest in alkaline cleaning to remove such fines and contaminants. However, the treatment of aluminum cans with either alkaline or acidic cleaners generally results in differential rates of metal surface etch on the outside versus on the inside of the cans. For example, optimum conditions required to attain an aluminum fine-free surface on the inside of the cans usually leads to can mobility problems on conveyors because of the increased roughness on the outside can surface.

Aluminum cans that lack a low coefficient of static friction (hereinafter often abbreviated as "COF") on the outside surface usually do not move past each other and through the trackwork of a can plant smoothly. Clearing the jams resulting from failures of smooth flow is inconvenient to the persons operating the plant and costly because of lost production. The COF of the internal surface is also important when the cans are processed through most conventional can decorators. The operation of these machines requires cans to slide onto a rotating mandrel which is then used to transfer the can past rotating cylinders which transfer decorative inks to the exterior surface of the cans. A can that does not slide easily on or off the mandrel can not be decorated properly and results in a production fault called a "printer trip". In addition to the misloaded can that directly causes such a printer trip, three to four cans before and after the misloaded one are generally lost as a consequence of the mechanics of the printer and conveyor systems. Thus, a need has arisen in the can manufacturing industry, particularly with aluminum cans, to modify the COF on the outside and inside surfaces of the cans to improve their mobility. Past improvements in this respect have led to still further increases in conventional can processing speeds, so that only the lower part of the range of previously acceptable COF values is now acceptable in many plants.

An important consideration in modifying the surface properties of cans is the concern that such modification may interfere with or adversely affect the ability of the cans to be printed when passed to a printing or labeling station. For example, after cleaning the cans, labels may be printed on their outside surface, and lacquers may be sprayed on their inside surface. In such a case, the adhesion of the paints and lacquers is of major concern. It is therefore an object of this invention to improve mobility without adversely affecting adhesion of paints, decorating inks, lacquers, or the like.

In addition, the current trend in the can manufacturing industry is directed toward using thinner gauges of aluminum metal stock. The down-gauging of aluminum can metal stock has caused a production problem in that, after washing, the cans require a lower drying oven temperature in order to pass the column strength pressure quality control test. However, lowering the drying oven temperature resulted in the cans not being dry enough when they reached the printing station, and caused label ink smears and a higher rate of can rejects.

One means of lowering the drying oven temperature would be to reduce the amount of water remaining on the surface of the cans after water rinsing. Thus, it is advantageous to promote the drainage of rinse water from the treated can surfaces.

In summary, it is desirable to provide a means of improving the mobility of aluminum cans through single filers and printers to increase production, reduce line jams, minimize down time, reduce can spoilage, improve or at least not adversely affect ink laydown, and enable lowering the drying oven temperature of washed cans.

In the most widely used current commercial practice, at least for large scale operations, aluminum cans are typically subjected to a succession of six cleaning and rinsing operations as described in Table A below. It is preferable to include another stage, usually called "Prerinse", before any of the stages shown in Table A; when used, this stage is usually at ambient temperature (i.e., 20–25° C.) and is most preferably supplied with overflow from Stage 3 as shown in Table A, next most preferably supplied with overflow from Stage 1 as shown in Table A, and may also be tap water. Any of the rinsing operations shown as numbered stages in Table 1 may consist of two or preferably three sub-stages, which in consecutive order of their use are usually named "drag-out", "recirculating", and "exit" or "fresh water" sub-stages; if only two sub-stages are used, the name "drag-out" is omitted. Most preferably, when such sub-stages are used, a blow-off follows each stage, but in practice such blow-offs are often omitted. Also, any of the stages numbered 1 and 4–6 in Table A may be omitted in certain operations.

It is currently possible to produce a can which is satisfactorily mobile and to which subsequently applied inks and/or lacquers have adequate adhesion by using suitable surfactants either in Stage 4 or Stage 6 as noted above. Preferred treatments for use in Stage 6 are described in U.S. Pat. Nos. 4,944,889 and 4,859,351, and some of them are commercially available from the Parker Amchem Division of Henkel Corporation (hereinafter often abbreviated as "PAM") under the name "Mobility Enhancer™ 40" (hereinafter often abbreviated "ME-40™"). However, it has been found that when a conversion coating, particularly a highly preferred conversion coating formed by treating the can surfaces with an aqueous liquid composition containing simple and complex fluoride ions along with phosphoric, nitric, and gluconic acids, is used in step 4, without any additional material to promote the formation of a lubricant and surface conditioning

TABLE A

| STAGE NUMBER | ACTION ON SURFACE DURING STAGE |
|---|---|
| 1 | Aqueous Acid Precleaning |
| 2 | Aqueous Acid and Surfactant Cleaning |
| 3 | Tap Water Rinse |
| 4 | Mild Acid Postcleaning, Conversion Coating, or Tap Water Rinse |
| 5 | Tap Water Rinse |
| 6 | Deionized ("DI") Water Rinse |

layer on the substrate surface, ME-40™ sometimes does not produce satisfactory results when used in Stage 6 as shown in Table A.

DESCRIPTION OF THE INVENTION

Object of the Invention

A major object of the present invention is to provide a lubricant and surface conditioner forming composition (hereinafter usually abbreviated as "LSCFC") that will achieve satisfactory COF reduction when used as the last aqueous treatment before drying the cans ("final rinse"), even on can surfaces already coated with a conversion coating by an earlier treatment stage. An alternative and/or concurrent objective is to overcome at least one of the difficulties with the prior art noted above. Other objects will be apparent from the further description below.

General Principles of Description

Other than in the operating examples, or where otherwise indicated, all numbers expressing quantities of ingredients or reaction conditions used herein are to be understood as modified in all instances by the term "about" in describing the broadest scope of the invention. Practice within the numerical limits given, however, is generally preferred.

Also, throughout the specification, unless there is an explicit statement to the contrary: the description of groups of chemical materials as suitable or preferred for a particular ingredient according to the invention implies that mixtures of two or more of the individual group members are equally as suitable or preferred as the individual members of the group used alone; the specification of chemical materials in ionic form should be understood as implying the presence of some counterions as necessary for electrical neutrality of the total composition; in general, such counterions preferably should first be selected to the extent possible from the ionic materials specified as part of the invention; any remaining counterions needed may generally be selected freely, except for avoiding any counterions that are detrimental to the objects of the invention; any explanation of an abbreviation applies to all subsequent uses of the same abbreviation and applies mutatis mutandis to grammatical variations of the initial abbreviation.

SUMMARY OF THE INVENTION

In accordance with this invention, it has been found that oxa acids and their methyl esters corresponding to general formula (I):

$$CH_3(CH_2)_nO(CH_2CH_2O)_xCH_2C(O)OR \quad (I),$$

where each of n and x, which may be the same or different, is a positive integer and R represents H or $CH_3$, when dissolved and/or dispersed in water provide an excellent lubricant and surface conditioner forming composition that is effective in reducing COF values on substrates that have been contacted with such a lubricant and surface conditioner forming composition and subsequently dried, even when the substrates have been conversion coated and rinsed before any contact with the lubricant and surface conditioner forming composition. Materials according to general formula (I) may be used together with other surfactants, including some constituents of previously known lubricant and surface conditioner forming compositions, and in some but not all instances, a further improvement in properties can be obtained in this way. Polyallylene oxide block containing ethers and esters are particularly useful auxiliary surfactants when used together with compounds according to formula (I), which may be denoted hereinafter as the "primary lubricant and surface conditioner forming component". Other optional and conventional materials such as biocides, antifoarn agents, and the like may also be included in the compositions according to the invention without changing the essence of the invention.

Various embodiments of the invention include a concentrated additive that when mixed with water will form a working aqueous liquid lubricant and surface conditioner forming composition as described above; such an aqueous liquid working composition itself; and processes including contacting a metal surface, particularly but not exclusively a previously conversion coated aluminum surface, with such an aqueous liquid working composition.

DESCRIPTION OF PREFERRED EMBODIMENTS

In general formula (I), the value of n preferably is at least, with increasing preference in the order given, 3, 4, 5, 6, 7, 8, 9, 10, or 11 and independently preferably is not more than, with increasing preference in the order given, 20, 19, 18, 17, 16, 15, or 14; independently, the value of x preferably is at least, with increasing preference in the order given, 2, 3, 4, or 5 and independently preferably is not more than 25, 23, 21, 19, 17, 15, 14, 13, 12, or 11. Additionally and independently, at least 20% of the molecules present that conform to general formula (I) preferably do so when the value of x is at least, with increasing preference in the order given, 8, 9, 10, or 11.

Auxiliary surfactants if used in a working lubricant and surface conditioner forming composition according to the invention are preferably selected from the group consisting of materials corresponding to one of the general formulas (I)–(V):

$$R^1O(CH_2CH_2O)_y(CH_2CHCH_3O)_2H \quad (II),$$

$$R^2C(O)O(CH_2CH_2O)_pH \quad (III),$$

$$HO(CH_2CH_2O)_q(CH_2CHCH_3O)_r(CH_2CH_2O)_qH \quad (IV),$$

$$HO(CH_2CHCH_3O)_s(CH_2CH_2O)_t(CH_2CHCH_3O)_{s'}H \quad (V),$$

where: $R^1$ is a moiety selected from the group consisting of (i) saturated and unsaturated straight and branched chain aliphatic monovalent hydrocarbon moieties and (ii) saturated and unsaturated straight and branched chain aliphatic monovalent hydrocarbon moiety substituent bearing phenyl moieties in which the aromatic ring is directly bonded to the oxygen atom appearing immediately after the $R^1$ symbol in formula (II); each of y and p, which may be the same or different, is a positive integer; z is zero, one, or two; $R^2$ is selected from the group consisting of saturated and unsaturated straight and branched chain aliphatic monovalent hydrocarbon moieties; each of q and q', which may be the same or different but are, primarily for reasons of economy, preferably the same, represents a positive integer that independently preferably is at least 2, or more preferably is at least 3, and independently preferably is not more than, with increasing preference in the order given, 10, 9, 8, 7, 6, 5, 4, or 3; r represents a positive integer that preferably is at least, with increasing preference in the order given, 3, 5, 8, 12, 16, 20, 24, 26, 28, or 29 and independently preferably is not more than with increasing preference in the order given, 60, 55, 50, 45, 41, 38, 36, 34, 32, or 31; each of s and s', which may be the same or different but are, primarily for reasons of economy, preferably the same, represents a positive integer that independently preferably is at least, with increasing preference in the order given, 10, 15, 20, 22, 24, or 26 and independently preferably is not more than, with increasing preference in the order given, 63, 55, 48, 42, 37, 33, 30, or 28; and t represents a positive integer that preferably is at least, with increasing preference in the order given, 2, 3, 4, 5, or 6 and independently preferably is not more than, with increasing preference in the order given, 20, 18, 16, 14, 12, 10, 8, 7, or 6.

More preferably, primarily for reasons of economy, in each of $R^1$ and $R^2$ independently the aliphatic portion preferably is saturated, and independently preferably is straight chain or is straight chain except for a single methyl substituent Also, independently of these other preferences and independently for each of moieties $R^1$ and $R^2$, the total number of carbon atoms in the moiety preferably is at least, with increasing preference in the order given, 8, 10, 11, 12, 13, or 14 and independently preferably is not more than, with increasing preference in the order given, 22, 21, 20, 19, or 18. Independently of all other stated preferences, the values of y, z, and p, each independently, are such that each of (i) molecules according to general formula (II) and (ii) molecules according to general formula (III), each independently, have hydrophilelipophile balance (hereinafter usually abbreviated as "HLB") values, these values being defined as one-fifth of the percentage by weight of ethylene oxide residues in the molecules, that are at least, with increasing preference in the order given, 8.0, 8.5, 9.0, 9.5, 10.0, 10.5, or 11.0 and independently preferably are not more than, with increasing preference in the order given, 19.5, 19.2, 18.9, 18.6, or 18.3.

The ratio of (i) the sum of (i.1) the total concentration of auxiliary surfactant according to one or more of general formulas (II) through (V) and of (i.2) any part of the primary lubricant and surface conditioner forming component that conforms to general formula (I) when x is not more than 7 to (ii) the concentration of primary lubricant and surface conditioner forming component according to formula (I) when x is at least 8 preferably is not greater than, with increasing preference in the order given, 10:1.0, 9.0:1.0, 8.0:1.0, 7.0:1.0, 6.5:1.0, 6.0:1.0, 5.5:1.0, 5.0:1.0, 4.5:1.0, or 4.0:1.0 and, when mininmization of water-breaks on the treated surfaces is desired, independently preferably is at least, with increasing preference in the order given, 0.2:1.0, 0.4:1.0, 0.50:1.0,0.60:1.0,0.70:1.0,0.80:1.0,0.90:1.0, 1.0:1.0, 1.1:1.0, 1.2:1.0, 1.3:1.0, 1.4:1.0, or 1.5:1.0, and, unless an extraordinarily low COF is needed, more preferably is at least, with increasing preference in the order given, 2.0:1.0, 2.5:1.0, 3.0:1.0, 3.5:1.0, or 4.0:1.0.

In a working aqueous liquid lubricant and surface conditioner forming composition according to the invention, the total concentration of material corresponding to any of general formulas (I) through (V) above preferably is at least, with increasing preference in the order given, 0.001, 0.002, 0.004, 0.007, 0.010, 0.020, 0.030, 0.035, 0.040, 0.044, 0.048, 0.052, 0.056, 0.060, 0.064, 0.068, 0.072, 0.076, 0.080, 0.084, 0.088, 0.092, 0.096, or 0.100 grams per liter (hereinafter usually abbreviated as "g/L") and independently preferably is, primarily for reasons of economy, not more than, with increasing preference in the order given, 1.0, 0.90, 0.80, 0.70, 0.60, 0.50, 0.40, 0.35, 0.30, 0.25, 0.21, 0.17, 0.15, 0.13, or 0.11 g/L. In a concentrate composition according to the invention, suitable for preparing such a working aqueous liquid lubricant and surface conditioner forming composition by mixing the concentrate composition with water, the total concentration of material corresponding to any one of general formulas (I) through (V) preferably is at least, with increasing preference in the order given, 0.5, 1.0, 1.3, 1.6, 1.9, 2.2, or 2.4%. Such a concentrate may be mixed with water at a level of 0.2 to 1.6 volume % of the concentrate, with the balance water, to prepare satisfactory working lubricant and surface conditioner forming compositions according to the invention.

A lubricant and surface conditioner forming composition according to the invention preferably is contacted with the surface previously prepared by conversion coating at the normal ambient temperature prevailing in spaces conditioned for human comfort, i.e., between 15 and 30° C., or more preferably between 20 and 25° C., although any temperature at which the composition is liquid can be used. When contact is at the preferred temperature, the time of contact preferably is at least, with increasing preference in the order given, 1, 2, 3, 5, 7, 9, 11, 13, 15, 17, 18, or 19 seconds (hereinafter usually abbreviated as "sec") and independently, primarily for reasons of economy, preferably is not more than, with increasing preference in the order given, 600, 300, 200, 180, 150, 120, 100, 80, 70, 60, 50, 40, 35, 30, 26, 23, or 21 sec.

After contact with the lubricant and surface conditioner forming composition according to the invention and subsequent drying, the COF value achieved on the exterior side wall of the cans treated preferably is not more than, with increasing preference in the order given, 1.0, 0.90, 0.80, 0.75, 0.70, 0.65, 0.60, 0.55, 0.50, 0.45, or 0.40.

Any conversion coating which is contacted with a lubricant and surface conditioner forming composition according to this invention preferably has been formed as described in U.S. Pat. No. 4,148,670 of Apr. 10, 1979 to Kelly, the entire specification of which, except to any extent that it may be inconsistent with any explicit statement herein, is hereby incorporated herein by reference.

The effective fluoride activity of the conversion coating forming aqueous liquid composition for purposes of this description is measured by use of a fluoride sensitive electrode as described in U.S. Pat. No. 3,431,182 and commercially available from Orion Instruments. Fluoride activity was specifically measured relative to a 120E Activity Standard Solution commercially available from the Parker Amchem ("PAM") Division of Henkel Corporation by a procedure described in detail in PAM Technical Process Bulletin No. 968, Revision of Apr. 19, 1989. The Orion Fluoride Ion Electrode and the reference electrode provided with the Orion instrument are both immersed in the noted Standard Solution and the millivolt meter reading is adjusted to 0 with a Standard Knob on the instrument, after waiting if necessary for any drift in readings. The electrodes are then rinsed with deionized or distilled water, dried, and immersed in the sample to be measured, which should be brought to the same temperature as the noted Standard Solution had when it was used to set the meter reading to 0. The reading of the electrodes immersed in the sample is taken directly from the millivolt (hereinafter often abbreviated "mv" or "mV") meter on the instrument. With this instrument, lower positive mv readings indicate higher fluoride activity, and negative mv readings indicate still higher fluoride activity than any positive readings, with negative readings of high absolute value indicating high fluoride activity. The fluoride activity of the conversion coating forming composition preferably is not more than, with increasing preference in the order given, −50, −60, −70, −80, −85, or −89 mv and independently preferably is at least, with increasing preference in the order given, −120, −115, −110, −105, −100, −95, or −91 mv.

The temperature at which the conversion coating composition is contacted with the metal substrate being treated, before being contacted with a lubricant and surface conditioner forming composition according to the invention, preferably is at least, with increasing preference in the order given, 25, 30, 35, 38, or 40° C. and independently preferably is, primarily for reasons of economy, not more than, with increasing preference in the order given, 70, 60, 55, 50, 45, 43, or 41° C., and the time of contact at these temperatures preferably is at least, with increasing preference in the order given, 1, 3, 5, 7, 9, 11, 13, 15, 17, 19, 21, 23, or 24 sec and independently preferably is, primarily for reasons of economy, not more than, with increasing preference in the order given, 600, 300, 200, 180, 150, 120, 100, 80, 70, 60, 50, 40, 35, 32, 29, 27, or 26 sec.

Before conversion coating, the metal surface to be treated should be well cleaned, preferably with an acid cleaning composition, more preferably one that also contains fluoride and surfactants. Suitable cleaners are known to those skilled in the art.

The invention and its advantages may be further appreciated by consideration of the following working examples and comparisons.

EXAMPLES AND COMPARISONS

Materials Used

Alodine® 404 is a non-chromate conversion coating process for drawn and ironed aluminum cans, which conforms to the preferred teachings of U.S. Pat. No. 4,148,670. Needed materials and directions are available from PAM.

Aluminum nitrate was used in the form of a 59.5–61% solution of aluminum nitrate nonahydrate in water.

Aluminum sulfate was used in the form of technical alum with an average molecular weight of 631.34 and 8.55% of aluminum atoms, with two such atoms per molecule.

Ammonium bifluoride, technical grade, >97%, typically 98.3%, of $NH_4HF_2$, with the balance predominantly $NH_4F$, was used.

Ammonium hydroxide, 26° Baumé, technical grade, was used when needed to adjust free acid and/or pH values. (This material is also referred to as "aqueous ammonia".)

Carbowax® 350 was commercially obtained from the Industrial Chemicals Division of Union Carbide Chemicals and Plastics Company Inc. in Danbury, Conn. and is reported by its supplier to be methoxy polyethylene glycols with an average molecular weight of 350.

CL 300™ Cupping Lubricant was commercially obtained from LTC Inc. in Pittsburgh, Pa. and is a metal working lubricant used in the large scale manufacturing of drawn and ironed aluminum cans, where it is applied to the aluminum prior to the cupping operation.

Colloid 999™ defoamer was commercially obtained from Rhône-Poulenc, Cranbury, N.J. and is reported by its supplier to contain a polyol, a glycol ester, a fatty acid, and amorphous silica.

DF 50™ metal working coolant is available from LTC Inc. in Pittsburgh, Pa. and is used in the manufacturing of drawn and ironed aluminum cans, where it is circulated through the tool pack in the bodymaker.

Ethal OA-23 was commercially obtained from Ethox Chemical Inc. in Greenville, S.C. and is reported by its supplier to be polyoxyethylene (23) oleyl alcohol.

Ethox™ MI-14 was commercially obtained from Ethox Chemical Inc. in Greenville, S.C. and is reported by its supplier to be a polyoxyethylene ester of iso-stearic acid, with an average of 14 oxyethylene units per molecule.

GP 295™ defoamer was obtained commercially from Genesee Polymer Corp., Flint, Mich. and is reported by its supplier to have a proprietary chemical constitution with a mineral oil base.

Kathon™ 886MW biocide was obtained commercially from Rohm and Haas Company and is reported by its supplier to contain 10–12% of 5-chloro-2-methyl-4-isothiazolin-3-one, 3–5% of 2-methyl-4-isothiazolin-3-one, 14–18% of magnesium nitrate, 8–10% of magnesium chloride, and the balance water.

Neodol® 25-7 surfactant was obtained from Shell Chemical Company in Houston, Tex. and is reported by its supplier to be polyoxyethylene(7) $C_{12}$–$C_{15}$ linear alcohols.

Neodox™ 23-6 surfactant was obtained from Shell Chemical Company in Houston, Tex. and is reported by its supplier to be polyoxyethylene(6) $C_{12}$–$C_{13}$ alkyl carboxylic acid.

Neodox™ 25-11 surfactant was obtained from Shell Chemical Company in Houston, Tex. and is reported by its supplier to be polyoxyethylene(11) $C_{12}$ –$C_{15}$ alkyl carboxylic acid.

Neodox™ 91-7 and 91-5 were both obtained from Shell Chemical Company in Houston, Tex. and are reported by their supplier to be polyoxyethylene(7) and polyoxyethylene (5) $C_9$–$C_{11}$ alkyl carboxylic acid respectively.

Plurafac® D-25 was obtained from BASF Performance Chemicals in Parsippany, N.J. and is reported by its supplier to be polyoxyethylene(11), polyoxypropylene (6) ethers of a mixture of synthetic $C_{12}$–$C_{18}$ alcohols.

Pluronic® L-61 and 31RI were commercially supplied by BASF Performance Chemicals in Parsippany, N.J. and are reported by their supplier to be respectively (i) block copolymers of ethylene oxide and propylene oxide with the general structure:

$HO—(CH_2CH_2O)_x—(CH_2(CH_3)CHO)_y—(CH_2CH_2O)_x—H$, where x=x'=3 and y=30 and (ii) block copolymers of propylene oxide and ethylene oxide with the general structure:

$HO—(CH(CH_3)CH_2O)_x—(CH_2CH_2O)_y—(CH_2(CH_3)CHO)_x—H$., where the average values of x and x' both are about 27 and the average value of y is about 6, so that a mole of the material contains 3100 grams of propylene oxide and 282 grams of ethylene oxide.

Ridoline® 123 concentrate is suitable for making a fluoride containing acidic cleaner for drawn and ironed aluminum cans. The concentrate and directions for using it are commercially available from PAM.

"SF 7063" is an experimental oxa acid methyl ester with the structural formula $CH_3(CH)_{13}O(CH_2CH_2O)_{(average=8.5)}CH_2C(O)OCH_3$. It is not believed to be commercially available and was made from the corresponding ethoxylated acid.

"SF 7112" is an experimental oxa acid methyl ester with the structural formula $CH_3(CH_2)_{13}O(CH_2CH_2O)_{(average=5)}(CH_2CH(CH_3)O)CH_2C(O)OCH_3$. This also is not believed to be commercially available and was made from the corresponding ethoxylated acid.

"SF 7147" is an experimental oxa acid methyl ester with the structural formula $CH_3(CH_2)_{7-9}O(CH_2CH_2O)_5CH_2C(O)OCH_3$. This also is not believed to be commercially available and was made from the corresponding ethoxylated acid.

Sulfric acid used was a technical grade, approximately 50% $H_2SO_4$ in tap water. (Each lot was assayed before use to determine percent sulfuric acid, in order to assure the reliability of the significant figures given below for $H_2SO_4$ concentration.)

Surfonic™ LF-17 was commercially obtained from Huntsman Corporation in Houston, Tex., and is reported by its supplier to be a non-ionic surfactant that consists of ethoxylated and propoxylated linear primary 12–14 carbon number alcohol molecules.

Tergitol® Nonionic Surfactant Min-foam 1X was commercially obtained from Union Carbide Corp. and is reported by its supplier to be a nonionic surfactant consisting of a mixture of $C_1$–$C_{15}$ linear secondary alcohols reacted with ethylene oxide and propylene oxide and to have the general structural formula:

$$CH_3(CH_2)_{10-14}O(CH_2CH_2O)_i\{CH_2CH_2O/CH_2CH(CH_3)O\}_jCH_2CH(CH_3)OH,$$

where each of i and j, which may be the same or different, represents a non-negative integer.

Tergitol® TMN-6 was commercially supplied by the Industrial Chemicals Division of Union Carbide Chemicals and Plastics Company Inc. in Danbury, Conn. and is reported by its supplier to be a 90% aqueous solution of a nonionic wetting agent produced by the reaction of 2,6,8-trimethyl4-nonanol with ethylene oxide, with an average of 8 moles of ethylene oxide per mole of alcohol.

Tergitol® 15-S-9 was commercially supplied by the Industrial Chemicals Division of Union Carbide Chemicals and Plastics Company Inc. in Danbury, Conn. and is reported by its supplier to be polyoxyethylene (9) linear secondary $C_{11}$–$C_{15}$ alcohols.

Triton™ N-101 was commercially obtained from the Industrial Chemicals Division of Union Carbide Chemicals and Plastics Company Inc. in Danbury, Conn. and is reported by its supplier to be a nonionic surfactant consisting of polyethoxylated nonyl-phenol with an average of 9.5 moles of ethylene oxide per molecule.

Trylox® 5922 is a polyoxyethylene(25) triglyceride of hydrogenated castor oil and was commercially obtained from Henkel Corporation Textile Chemicals in Charlotte, N.C.

All other materials identified by chemical name below were reagent grade materials.

Cleaner Solutions

The cleaning solutions were prepared using Ridoline® 123 concentrate, ammonium bifluoride, aqueous hydrofluoric acid (Reagent Grade at 52%), sulfuric acid (66° Bè), and aluminum sulfate as described in the PAM Technical Process Bulletin No. 1580 dated Jan. 3, 1994 for the Ridoline® 123 Process. The Free Acid, Total Acid and Fluoride Activity of the cleaner solution were checked as described in this Technical Process Bulletin. It addition to the five components listed above, ammonia was added if the Free Acid of the initially prepared solution was higher than desired.

Four different cleaner solutions were used to prepare cans for these examples; these solutions consisted of water, the ingredients specified below, and amounts of the other ingredients listed above to produce the characteristics listed below, in the manner described in the Technical Process Bulletin. Cleaner Solution #1 ("CS#l") contained 1.132 weight/volume %[1] of Ridoline® 123 concentrate and had Free Acid at 8 points, Total Acid at 18 points, and a Fluoride Activity of +30 mV, measured as described above for the conversion coating composition. Cleaner Solution #2 ("CS#2") had the same characteristics as CS#1, except that the Fluoride Activity was 0 mV. Cleaner Solution #3 ("CS#3") was the same as CS#2 except that it also contained 1000 parts per million in total of a lubricant mixture which consisted of 26.75% of LTC CL 300 Cupping Lubricant and 73.25% of LTC DF 50 bodymaker coolant. Cleaner Solution #4 ("CS#4") contained 1.698 weight/volume % of Ridoline® 123 concentrate and had Free Acid at 12 points, Total Acid at 32 points, and a Fluoride Activity of 0 mV.

[1] "Weight/volume %" means that the weight of the material so specified contained within a given volume is equal to the weight of the stated percentage of the same given volume of pure water. Thus, 10 weight/volume %=100 grams per liter, 1 weight/volume %=10 grams per liter, etc.

Conversion Coating Solutions

A 0.5 or 0.25 volume/volume % solution of Alodine® 404 concentrate was prepared. Aqueous ammonia was added as required to adjust the pH of the solution to the desired value. Aluminum nitrate solution was added to adjust the Fluoride Activity to −90 mV. The temperature of this solution was maintained at 40.5° C. as it was sprayed onto the cleaned cans.

Lubricant and Surface Conditioner Forming Compositions

These compositions were prepared by adding to deionized water the surfactants to be tested. Specifics are reported in tables below.

Apparatus and Procedure

All cans were prepared on a laboratory carousel can washer has been designed so that, in most respects[2], it closely simulates commercial scale operations. Each run used fourteen cans. The procedure used to prepare as that given in Table 1 unless otherwise noted below.

[2] Time periods for rinsing, standing, and blowing-off operations are higher in the laboratory apparatus, because it has only a single spray chamber, which must be used for all stages of the process. As a result, longer draining, rinsing, and blowing-off times are required in the laboratory apparatus to avoid contamination. In commercial scale apparatus, there separate chambers for each spraying and blowing-off step, so that much shorter times can be used. Extensive experience, however, has established that this difference between laboratory and commercial practice does not normally affect the results achieved.

TABLE 1

CAN PROCESSING SEQUENCE AND CONDITIONS

| Stage # | Process | Temperature, ° C. | Time in Seconds for: Spray | Dwell | Blow-Off |
|---|---|---|---|---|---|
| 1 | Precleaning with pH 2 Aqueous Solution of $H_2SO_4$ | 55 | 30 | 10 | 30 |
| 2 | Cleaning Solution | 60 | 60 | 10 | 30 |
| 3 | Tap Water Rinse | Ambient | 30 | 10 | 30 |
| 4 | Conversion Coating | 41 | 25 | 20 | 30 |
| 5 | Tap Water Rinse | Ambient | 30 | 0 | 0 |
| 6 | Deionized Water Rinse | Ambient | 90 | 0 | 30 |
| 7 | Lubricant and Surface Conditioner Forming | Ambient | 20 | 20 | 20 |
| Dry | Oven Drying | 150 | — | 300 | — |

After completion of the steps shown in Table 1, some of the cans were taken to a commercial can plant and provided with final surface finishes in its high speed production line.

The interior coating used for all the cans was Glidden 640C552, a waterborne coating supplied by the The Glidden Company (division of ICI Paints), Westlake, Ohio. The interior coating weight was 135–140 mg/0.35 liter (12 fluid ounces) size can. Various labels were applied to the exterior of the cans. They all consisted of inks supplied by INX, Inc., Elk Grove Village, Ill. All labelled cans were then coated with PPG 2625XL Overvarnish, supplied by PPG Corp. in Delaware, Ohio.

Test Procedures

Coefficient of Friction of the Exterior Sidewalls ("COF")

The cans were evaluated for this property, after completion of the steps shown in Table 1, with a laboratory static friction tester. This device measures the static friction associated with the outside sidewall surface characteristics of aluminum cans. This is done by using a ramp which is raised through an arc of 90° by using a constant speed motor, a spool and a cable attached to the free swinging end of the ramp. A cradle attached to the bottom of the ramp is used to hold two cans on their sides in horizontal position approximately 13 millimeters apart, with their domes facing the fixed end of the ramp and restrained from sliding along the ramp as it is raised by the cradle. A third can is laid on its side upon the first two cans, with the dome of the third can facing the free swinging end of the ramp, and the edges of all three cans are aligned so that they are even with each other. The cradle does not restrain the movement of the third can.

As the ramp begins to move through its arc, a timer is automatically actuated. When the ramp first reaches an angle at which the third can slides freely from the two lower cans, a photoelectric switch shuts off the timer. The elapsed time, recorded in seconds, is commonly referred to as "slip time". The coefficient of static friction is equal to the tangent of the angle swept by the ramp at the time the can begins to move. This angle in degrees with the particular apparatus used is equal to [4.84+(2.79·t)], where t is the slip time. (The angle at which the can begins to slip is sometimes reported alternatively or additionally to characterize the mobility of the cans tested.)

Dome Staining

The domes were removed from the cans to be tested. They were immersed in a solution which consisted of 0.2 gram per liter of sodium tetraborate decahydrate and 0.1 gram per liter of potassium chloride in deionized water. The pH of this solution was adjusted to 9.2 using either sodium hydroxide or hydrochloric acid. It was heated to 68.3° C. The can domes were immersed in the hot solution for 30 minutes. (Each batch of this solution was used for only one test.) The can domes were then removed, rinsed with deionized water and dried. The following scale was used to report the dome staining performance of the domes: 5=Best, no discoloration to 0=complete dark discoloration, equivalent to the performance of a can without a conversion coating.

Adhesion Testing

The domes of the cans to be tested were removed from the sidewalls. The sidewalls were straightened. The can sections were immersed in a boiling solution consisting of 0.33 g/l of magnesium sulfate heptahydrate, 0.33 g/l of calcium chloride dihydrate, 0.17 g/l of calcium carbonate and 0.7% by volume of liquid detergent in deionized water for 15 minutes. In those tests described as with "US detergent" in the following text and tables, a concentration of 7 ml/l of Dawn® Free detergent from Proctor and Gamble was used. A Chilean detergent which was obtained from Reynolds in Chile was used in examples noted to be with "Chilean detergent". This Chilean detergent was a green viscous liquid with a citrus odor. Its manufacturer, chemical characteristics, and name are not known.

The can sections were removed from the test solution, rinsed with deionized water and dried with a paper towel before testing.

The areas to be tested, which were the center of the interior dome, the interior sidewall and the exterior sidewall, were scribed in a pattern consisting of two sets of five parallel scribes which intersected at right angles. Two areas, one near the open end of the can and one near the dome end, were scribed on each of the interior and exterior sidewalls. Scotch® Brand No. 610 adhesive tape was applied to the scribed area and removed in a smooth motion. No loss of coating from the taped area, reported as a rating of 10, the highest rating possible in this test, was observed in any case reported below where the adhesion was measured.

SPECIFIC EXAMPLES

Comparative Examples Group 1

These examples were designed to test the effect of the Fluoride Activity of the cleaner and the pH of the Alodine® 404 conversion coating solution on the COF and organic coating adhesion of cans which have received a final rinse with an aqueous solution of Ethox™ MI-14. The effect of the concentration of the Ethox™ MI-14 was also investigated. The results of these examples are reported in Table 1.1.

TABLE 1.1

| FAIC, mV | Conversion Coating Composition | Ethox ™ MI-14 Concentration, % by Volume | COF | Rating for: Adhesion on: InD | InS | ExS | Dome Staining |
|---|---|---|---|---|---|---|---|
| 30 | none | 0.010 | 0.627 | 10 | 10 | 10 | 0.0 |
| 30 | AL404-Low | 0.010 | 0.954 | nt | nt | nt | 4.8 |
| 30 | AL404-High | 0.010 | 1.022 | nt | nt | nt | 4.8 |
| 30 | none | 0.020 | 0.488 | 10 | 10 | 10 | nt |
| 30 | AL404-Low | 0.020 | 0.705 | nt | nt | nt | nt |
| 30 | AL404-High | 0.020 | 1.016 | nt | nt | nt | nt |
| 30 | none | 0.040 | 0.469 | 10 | 10 | 10 | nt |
| 30 | AL404-Low | 0.040 | 0.545 | nt | nt | nt | nt |
| 30 | AL404-High | 0.040 | 0.540 | nt | nt | nt | nt |
| 0 | none | 0.010 | 0.596 | 10 | 10 | 10 | 0.0 |
| 0 | AL404-Low | 0.010 | 0.958 | nt | nt | nt | 5.0 |
| 0 | AL404-High | 0.010 | 1.193 | nt | nt | nt | 5.0 |

TABLE 1.1-continued

| FAIC, mV | Conversion Coating Composition | Ethox ™ MI-14 Concentration, % by Volume | COF | Rating for: Adhesion on: InD | InS | ExS | Dome Staining |
|---|---|---|---|---|---|---|---|
| 0 | none | 0.020 | 0.563 | 10 | 10 | 10 | nt |
| 0 | AL404-Low | 0.020 | 0.789 | nt | nt | nt | nt |
| 0 | AL404-High | 0.020 | 0.979 | nt | nt | nt | nt |
| 0 | none | 0.040 | 0.486 | 10 | 10 | 10 | nt |
| 0 | AL404-Low | 0.040 | 0.550 | nt | nt | nt | nt |
| 0 | AL404-High | 0.040 | 0.706 | nt | nt | nt | nt |
| 0 | none | 0.080 | 0.414 | 10 | 10 | 10 | nt |

Abbreviations in and Notes for Table 1.1
"FAIC" = "Fluoride Activity in Principal Cleaner Composition" (Stage 2 from Table 1);
InD = Interior Dome;
InS = Interior Sidewall;
ExS = Exterior Sidewall;
AL404 = Alodine ® 404 chromium-free conversion coating forming concentrate; and
nt = not tested.
"High" means pH 3.1;
"Low" means pH 3.4.
The cleaning composition used was CS#1 or CS#2 as defined above.

Statistical analysis of the data in Table 1.1 indicates that the Fluoride Activity of the cleaner has no significant effect on the COF of the cans. The COF becomes lower as the concentration of Ethox™ MI-14 increases. The application of a conversion coating to cans prior to the final rinse increases their COF. The higher pH conversion coating solution, "AL 404-Low", does not increase the COF of conversion coated cans as much as the more active conversion coating solution with pH=3. 1, "AL 404-High."

None of the variables tested had any effect on the adhesion of organic coatings or the dome staining performance of the conversion coated cans. When the concentration of Ethox™ MI-1 4 was greater than 0.2 g/l, there were noticeable deposits of dried white residue in the exterior dome, at the contact marks (the region where adjacent cans touch), at the low point of the interior dome and along the cut edge (open end) on the can. (Cans are dried with their open ends pointing down.)

There was no loss of adhesion of the organic coatings in the areas where the white deposits were observed. There were, however, voids in the decoration on the exterior of the cans where the ink was not transferred to the can in these areas during the printing process. These voids in the ink are objectionable to users. Thus, although fully acceptable COF values below about 0.65 can be achieved when the concentration of Ethox™ MI-14 is high enough, the cans would fail to meet many customers' quality requirements because of the missing ink.

Examples and Comparison Examples Group 2

This Group was designed to determine the ability of the SF series oxa acid methyl esters and Trylox® 5922 to reduce the COF of aluminum cans which have been conversion coated by an Alodine® 404 process, relative to the reduction in COF achieved with Ethox™ MI-14. Some of the experimental solutions consisted of equal parts by weight of the oxa acid methyl esters and either Ethox™ MI-14 or Tergitol® Nonionic Detergent Min-foam 1X. The cleaning solution used was CS#4 as described above. Results are reported in Table 2.1.

Three of the four materials tested, SF 7063, SF 7112 and Trylox® 5922, gave lower COF's than Ethox™ MI-14. The addition of Ethox™ MI-14 to the SF 7112, SF 7147 and Trylox® 5922 lowers the observed COF. However, only the cans which were rinsed with the solution of SF 7063 had a COF below 0.65. Only these cans were decorated and tested for adhesion. The adhesion test results are in Table 2.1. None of these

TABLE 2.1

| Components in Lubricant and Surface Conditioner Forming Composition Used in Stage 7 (Table A) | | | | | Interior Dome |
|---|---|---|---|---|---|
| Component 1 | | Component 2 | | COF | Adhesion |
| Material | g/L | Material | g/L | Value | Rating |
| none | 0 | none | na | 1.925 | 10 |
| Ethox ™ MI-14 | 0.2 | none | na | 1.142 | 10 |
| SF 7063 | 0.2 | none | na | 0.509 | 10 |
| SF 7063 | 0.1 | Ethox ™ MI-14 | 0.1 | 0.780 | 10 |
| SF 7063 | 0.1 | Tergitol ™ Min-foam 1X | 0.1 | 0.769 | 10 |
| SF 7063 | 0.1 | none | na | 0.716 | nm |
| SF 7112 | 0.2 | none | na | 0.898 | nm |
| SF 7112 | 0.1 | Ethox ™ MI-14 | 0.1 | 0.648 | nm |
| SF 7112 | 0.1 | Tergitol ™ Min-foam 1X | 0.1 | 0.759 | nm |
| SF 7147 | 0.2 | none | na | 1.254 | nm |
| SF 7147 | 0.1 | Ethox ™ MI-14 | 0.1 | 1.135 | nm |
| SF 7147 | 0.1 | Tergitol ™ Min-foam 1X | 0.1 | 1.481 | nm |
| Trylox ™ 5922 | 0.2 | none | na | 0.919 | nm |
| Trylox ™ 5922 | 0.1 | Ethox ™ MI-14 | 0.1 | 0.867 | nm |
| Trylox ™ 5922 | 0.1 | Tergitol ™ Min-foam 1X | 0.1 | 1.193 | nm |

Additional Abbreviations for Table 2.1
na = not applicable;
nm = not measured.

cans had any adhesion loss in any area tested in the test with either US or Chilean detergent.

Example and Comparison Example Group 3

The ability of Neodox™ 23-6 and Neodox™ 25-11 to reduce the COF of cans which have been conversion coated with Alodine® 404 was tested in this Group. The effect of lower solution pH and of Ethox™ MI-14 and Triton™ N-101 additives to solutions of the Neodox™ materials on water-break, COF and coating adhesion was also tested. The results of these tests, in all of which the cleaning solution was CS#3 as defined above and the pH and Fluoride Activity of the conversion coating forming composition were 3.1 and −90 mV respectively, are reported in Table 3.1, parts A and B—the identification numbers in both parts of Table 3.1 indicate the same example, with some results reported in part A and others in part B.

TABLE 3.1

Part A

| Identification Number | Characteristics of the Stage 7 Lubricant and Surface Conditioner Forming Composition: Active Component 1 Name | Active Component 1 g/L | Active Component 2 Name | Active Component 2 g/L | COF on Exterior Sidewall |
|---|---|---|---|---|---|
| 3.1 | None | 0 | None | na | 1.824 |
| 3.2 | Neodox ™ 23-6 | 0.1 | None | na | 0.424 |
| 3.3 | Neodox ™ 23-6 | 0.2 | None | na | 0.413 |
| 3.4 | Neodox ™ 23-6 | 0.4 | None | na | 0.391 |
| 3.5 | Neodox ™ 23-6 | 0.8 | None | na | 0.385 |
| 3.6 | Neodox ™ 25-11 | 0.1 | None | na | 0.429 |
| 3.7 | Neodox ™ 25-11 | 0.2 | None | na | 0.409 |
| 3.8 | Neodox ™ 25-11 | 0.4 | None | na | 0.398 |
| 3.9 | Neodox ™ 25-11 | 0.8 | None | na | 0.385 |
| 3.10 | Neodox ™ 23-6 | 0.1 | Sulfuric Acid | pH 2.95 | 0.426 |
| 3.11 | Neodox ™ 23-6 | 0.05 | None | na | 0.757 |
| 3.12 | Neodox ™ 23-6 | 0.05 | Ethox ™ MI-14 | 0.05 | 0.494 |
| 3.13 | Neodox ™ 23-6 | 0.05 | Triton ™ N-101 | 0.05 | 0.46 |
| 3.14 | Neodox ™ 25-11 | 0.05 | Triton ™ N-101 | 0.05 | 0.538 |
| 3.15 | DI water | na | None | na | 1.497 |

TABLE 3.1

Part B

| Identification Number | % WBF after Stage 7 | Conductivity of Stage 7 Composition, μSiemens | Adhesion Rating on: InD | InS | ExS |
|---|---|---|---|---|---|
| 3.1 | nm | nm | 10 | 10 | 10 |
| 3.2 | nm | nm | 10 | 10 | 10 |
| 3.3 | nm | nm | 10 | 10 | 10 |
| 3.4 | nm | nm | 10 | 10 | 10 |
| 3.5 | nm | nm | 10 | 10 | 10 |
| 3.6 | mn | nm | 10 | 10 | 10 |
| 3.7 | 100 | nm | 10 | 10 | 10 |
| 3.8 | 100 | nm | 10 | 10 | 10 |
| 3.9 | 100 | nm | 10 | 10 | 10 |
| 3.10 | 70 | 500.0 | nm | nm | nm |
| 3.11 | 40–50 | 21.0 | nm | nm | nm |
| 3.12 | 60–70 | 18.0 | nm | nm | nm |
| 3.13 | 80 | 18.0 | 10 | 10 | 10 |
| 3.14 | 100 | 15.0 | 10 | 10 | 10 |
| 3.15 | nm | nm | 10 | 10 | 10 |

Both of the Neodox™ materials which were tested gave a dramatic reduction in COF. The values of 0.43 and lower are among the lowest ever observed on clean cans. At the lowest concentration, both Neodox™ materials gave extensive water-break, particularly on the exterior sidewalls of the cans. Neodox™ 23-6 gave water-break free cans at only the highest concentration, 0.8 g/l. With Neodox™ 25-11 the cans were water-break free at 0.2 g/l. The addition of sulfuric acid to the solution of Neodox™ 23-6 to give a pH of 2.95 reduced the extent of the water-break. This solution had a very high conductivity of 500 μSiemens. According to past experience, a Stage 7 lubricant and surface conditioner forming composition with a conductivity of greater than 50 μSiemens usually results in adhesion failures. The addition of either Ethox™ MI-14 or Triton™ N-101 to Neodox™ 23-6 reduced both the amount of water-break and the COF of cans. The addition of 0.05 g/l of Triton™ N-101 to a solution which contained 0.05 g/l of Neodox™ 25-11 gave cans which were water-break free and which had a low COF.

Cans from these examples were decorated on a commercial can processing line and then tested for adhesion. No adhesion loss was observed on any of the cans tested. The use of a Stage 7 lubricant and surface conditioner forming composition which contained Neodox™ surfactant did not reduce the dome staining resistance of the cans which were conversion coated with Alodine® 404—domes from every instance shown in Table 3.1, except Comparison Example 3.15 which had no treatment according to the invention, were rated perfect for this characteristic. Voids in the ink application were observed when the concentration of either Neodox™ surfactant in the Stage 7 lubricant and surface conditioner forming composition was greater than 0.4 g/l, but not at lower concentrations.

Example and Comparison Example Group 4

These examples were performed to investigate the following: (1) the ability of Neodol™ 25-7, a compound somewhat similar in structure to Neodox™ 23-6, differing only in the distribution of the carbon chain lengths in the base alcohol and the functional group on the terminal carbon in the polyoxyethylene chain, which is an alcohol for the Neodol™ material and a carboxylate for the Neodox™ material, to function as a Stage 7 lubricant and surface conditioner forming composition when applied over an Alodine® 404 conversion coating; (2) the ability of 1:1 mixture of Neodox™ 25-11 and Triton™ N-101 to function as a Stage 7 lubricant and surface conditioner forming composition when applied to cans which have not been conversion coated; and (3) the effect of drying oven temperature and drying time on the COF of cans which have been conversion coated by an Alodine® 404 process and contacted with a 1:1 mixture of Neodox™ 25-11 and Triton™ N-101. The cleaning solution used was CS#3 as defined above. Results are shown in Table 4.1.

TABLE 4.1

| Conversion Coating Used? | Characteristics of the Stage 7 Lubricant and Surface Conditioner Forming Composition: Active Component 1 Name | g/L | Active Component 2 Name | g/L | COF on Exterior Sidewall | Adhesion on Interior Dome Surface with Detergent from: U.S | Chile |
|---|---|---|---|---|---|---|---|
| Yes | None | 0 | None | na | 1.741 | 10 | 10 |
| Yes | Neodol ™ 25-7 | 0.1 | None | na | 1.494 | nm | nm |
| Yes | Neodol ™ 25-7 | 0.2 | None | na | 1.527 | nm | nm |
| Yes | Neodol ™ 25-7 | 0.4 | None | na | 1.117 | nm | nm |
| Yes | Neodol ™ 25-7 | 0.8 | None | na | 0.569 | nm | nm |
| Yes | Neodol ™ 25-7 | 0.05 | None | na | 1.422 | nm | nm |
| No | Neodol ™ 25-7 | 0.2 | None | na | 0.705 | nm | nm |
| No | Neodox ™ 25-11 | 0.05 | None | na | 0.445 | 10 | 10 |
| No | Neodox ™ 25-11 | 0.05 | Triton ™ N-101 | 0.05 | 0.406 | 10 | 10 |
| Yes | Neodox ™ 25-11 | 0.05 | Triton ™ N-101 | 0.05 | 0.621[1] | 10 | 10 |
| Yes | Neodox ™ 25-11 | 0.05 | Triton ™ N-101 | 0.05 | 1.155[2] | 10 | 10 |
| Yes | Ethox ™ MI-14 | 0.05 | None | na | 1.650[1] | nm | nm |

Footnotes for Table 4.1

[1,2]Instead of being dried as shown in Table 1, these were dried at 200° C. for 5 minutes for footnote 1 or 10 minutes for footnote 2.

Although Neodol™ 25-7 is more effective than Ethox™ MI-14 in reducing the COF of cans which have been conversion coated with Alodine® 404, it does not produce cans with COF values of no more than 0.65 unless the concentration is raised to the usually uneconomical level of 0.8 g/l.

The mixture of Neodox™ 25-11 and Triton™ N-101 also gives a very low COF when it is applied to cans which have not been conversion coated. Increasing the temperature of the drying oven to 200° C. (392° F.) gives a higher COF than does a drying oven temperature of 150° C. (302° F.). Prolonged exposure to the higher drying temperature (10 minutes vs 5 minutes) gives a large increase in COF.

Example Group 5

A very suitable concentrate composition according to the invention consists of the following ingredients: 25 parts of Neodox™ 25-11; 25 parts of Triton™ N-100; 0.0025 parts of Kathon™ 886MW; and water to a total of 1000 parts. Other excellent concentrate compositions according to the invention may be conveniently prepared from a base stock material that incorporates antifoam agents together with highly concentrated active ingredients for formation of a lubricant and surface conditioner coating on substrates. This base stock consists of 36 parts of Neodox™ 25-11 and 54 parts of Triton™ N-101 surfactants, and 5 parts each of Colloids 999™ and GP 295™ antifoam agents. Typical concentrates according to the invention contain 25 to 60 parts of this base stock together with 0.025 parts of Kathon™ 886MW biocide with the balance to 1000 parts being water. Deionized water is normally preferred for versatility and quality control, but in some locations tap water is also satisfactory.

Example and Comparison Example Group 6

CS#2 cleaning solution as described above was used for this group. Other process characteristics were as shown in Table 1. The active ingredients of the lubricant and surface conditioner forming compositions used, the resulting angles of first slip, which are related to the COF values as described above, and statistical parameters related to the average first slip angle values are all shown in Table 6.1.

All of the cans prepared using the LSCFC's tested in this experiment were 100% water-break free after the final rinse.

The simultaneous procedure of RS/1® Release 4.3, (Bolt Beranek and Newman, Inc., Software Products Division, Cambridge, Mass.), was used to simultaneously compare the mean COF values of all the experimental runs to determine where significant differences between the groups exist. The Student-Newman-Keuls multiple range test was used to compare each group of COF values with every other group, with the following conclusions:

Aluminum cans that had been conversion coated with Alodine® 404 had a significantly lower mean COF when an LSCFC which contained both Neodox® 25-11 and a non-ionic surfactant was applied than when the LSCFC contained only Neodox® 25-11.

The COF of cans that were treated with LSCFC's which consisted solely of Neodox® 91-7 or Neodox 91-5 were not significantly different from the COF of cans to which no LSCFC was applied.

TABLE 6.1

| # | First Surfactant and Its Conc. Name | g/L | Second Surfactant and Its Conc. Name | g/L | Av. Angle in ° of First Slip | Statistics on Av. Angle Values: Standard Deviation | # of Tests |
|---|---|---|---|---|---|---|---|
| 6.1 | None | None | None | NA | 57 | 2.5 | 15 |
| 6.2 | Ethox ® MI-14 | 0.20 | None | NA | 42 | 4.2 | 15 |
| 6.3 | Neodox ® 25-11 | 0.05 | None | NA | 41 | 6.5 | 15 |

TABLE 6.1-continued

| # | First Surfactant and Its Conc. Name | g/L | Second Surfactant and Its Conc. Name | g/L | Av. Angle in ° of First Slip | Statistics on Av. Angle Values: Standard Deviation | # of Tests |
|---|---|---|---|---|---|---|---|
| 6.4 | Neodox ® 25-11 | 0.05 | Triton ® N-101 | 0.05 | 31 | 5.2 | 15 |
| 6.5 | Neodox ® 25-11 | 0.05 | Plurafac ® D-25 | 0.05 | 31 | 4.5 | 15 |
| 6.6 | Neodox ® 25-11 | 0.05 | Neodol ® 23-7 | 0.05 | 30 | 5.8 | 15 |
| 6.7 | Neodox ® 25-11 | 0.05 | Tergitol ® TMN-6 | 0.05 | 35 | 4.0 | 15 |
| 6.8 | Neodox ® 25-11 | 0.05 | Tergitol ® 15-S-9 | 0.05 | 34 | 5.8 | 15 |
| 6.9 | Neodox ® 25-11 | 0.05 | Tergitol ® Min-foam 1X | 0.05 | 36 | 4.6 | 15 |
| 6.10 | Neodox ® 25-11 | 0.05 | Surfonic ® LF-17 | 0.05 | 33 | 4.5 | 15 |
| 6.11 | Neodox ® 25-11 | 0.05 | Ethox ® MI-14 | 0.05 | 33 | 4.1 | 15 |
| 6.12 | Neodox ® 25-11 | 0.05 | Ethal ® OA-23 | 0.05 | 33 | 3.4 | 15 |
| 6.13 | Neodox ® 25-11 | 0.05 | Carbowax ® 350 | 0.05 | 37 | 6.2 | 15 |
| 6.14 | Neodox ® 25-11 | 0.05 | Pluronic ® L-61 | 0.05 | 34 | 6.3 | 15 |
| 6.15 | Neodox ® 25-11 | 0.05 | Plurafac ® 31R1 | 0.05 | 32 | 3.7 | 15 |
| 6.16 | Neodox ® 91-7 | 0.05 | None | NA | 55 | 3.3 | 15 |
| 6.17 | Neodox ® 91-7 | 0.05 | Triton ® N-101 | 0.05 | 43 | 6.3 | 15 |
| 6.18 | Neodox ® 91-5 | 0.05 | None | NA | 59 | 2.8 | 15 |
| 6.19 | Neodox ® 91-5 | 0.05 | Triton ® N-101 | 0.05 | 46 | 5.5 | 14 |
| 6.20 | None | NA | None | NA | 56 | 3.7 | 15 |

Abbreviations in Table 6.1
"#" means "Number";
"Conc." means "Concentration";
"Av." means "Average";
"NA" means "not applicable".

When Triton® N-101 was added to the LSCFC's which contained Neodox® 91-7 or Neodox® 91-5, the COF of the cans, which had been conversion coated with Alodine® 404, was not significantly different from those to which an LSCFC consisting of either Ethox™ MI-14 or Neodoxe 25-11 had been applied.

When LSCFC's which contained Neodox® 25-11 and one of the nonionic surfactants Plurafac® D-25, Neodol® 25-7, Tergitol® TMN-6, Tergitol® 15-S-9, Tergitol® Min-Foam 1X, Surfonic LF-17, Ethox® MI-14, Ethal OA-23, Pluronic® L-61 and Pluronic® 31R1, was applied to cans which had been conversion coated with Alodine® 404, the mean COF did not differ significantly at the 95% confidence level from the mean COF obtained when an LSCFC consisting of Neodox® 25-11 and Triton® N-101 was applied to a conversion-coated aluminum can. The LSCFC which contained Carbowax™ 350 was the only one tested which gave a significantly higher COF than the LSCFC which contained Triton® N-101.

Example and Comparison Example Group 7

This group was especially designed to investigate more varied ratios between the primary and auxiliary surfactants than had been tested in Group 6. All procedures for this group were the same as for Group 6, except that (i) some cans that had not been conversion coated were tested along with cans that had been conversion coated as in Group 6 and (ii) the particular LSCFC's used were as shown in Table 7.1 below for cans that had not been conversion coated and in Table 7.2 for cans that had been conversion coated. In other experiments, the percent water-break-free surface produced on cans without conversion coating was measured, and these results are given in Table 7.3. All conversion coated cans produced completely water-break-free surfaces in these tests. If the cans have not been conversion coated and water-break-free surfaces are desired as usual, the ratio of nonionic auxiliary surfactant to oxa-acid surfactant should be at least 1.5:1.0 when all of the oxa-acid surfactant includes blocks of at least eight oxyethylene groups in each of its molecules.

TABLE 7.1

| # | No Conversion Coating before Treatment with LSCFC: First Surfactant and Its Conc. Name | g/L | Second Surfactant and Its Conc. Name | g/L | Corresponding COF Value |
|---|---|---|---|---|---|
| 7.1.1 | Neodox ® 25-11 | 0.025 | None | NA | 0.935 |
| 7.1.2 | Neodox ® 25-11 | 0.0375 | None | NA | 0.591 |
| 7.1.3 | Neodox ® 25-11 | 0.05 | None | NA | 0.429 |
| 7.1.4 | Neodox ® 25-11 | 0.0625 | None | NA | 0.393 |
| 7.1.5 | Neodox ® 25-11 | 0.075 | None | NA | 0.371 |
| 7.1.6 | Neodox ® 25-11 | 0.10 | None | NA | 0.379 |
| 7.1.7 | Neodox ® 25-11 | 0.075 | Triton ® N-101 | 0.025 | 0.375 |
| 7.1.8 | Neodox ® 25-11 | 0.0625 | Triton ® N-101 | 0.0375 | 0.385 |
| 7.1.9 | Neodox ® 25-11 | 0.05 | Triton ® N-101 | 0.05 | 0.398 |
| 7.1.10 | Neodox ® 25-11 | 0.0375 | Triton ® N-101 | 0.0625 | 0.417 |

TABLE 7.1-continued

| | No Conversion Coating before Treatment with LSCFC | | | | |
|---|---|---|---|---|---|
| | First Surfactant and Its Conc. | | Second Surfactant and Its Conc. | | Corresponding |
| # | Name | g/L | Name | g/L | COF Value |
| 7.1.11 | Neodox ® 25-11 | 0.025 | Triton ® N-101 | 0.075 | 0.418 |
| 7.1.12 | Neodox ® 25-11 | 0.00 | Triton ® N-101 | 0.10 | 0.785 |
| 7.1.13 | None | NA | None | NA | 1.482 |
| 7.1.14 | Neodox ® 25-11 | 0.075 | Neodol ® 25-7 | 0.025 | 0.371 |
| 7.1.15 | Neodox ® 25-11 | 0.0625 | Neodol ® 25-7 | 0.0375 | 0.367 |
| 7.1.16 | Neodox ® 25-11 | 0.05 | Neodol ® 25-7 | 0.05 | 0.371 |
| 7.1.17 | Neodox ® 25-11 | 0.0375 | Neodol ® 25-7 | 0.0625 | 0.387 |
| 7.1.18 | Neodox ® 25-11 | 0.025 | Neodol ® 25-7 | 0.075 | 0.393 |
| 7.1.19 | Neodox ® 25-11 | 0.0125 | Neodol ® 25-7 | 0.0875 | 0.423 |
| 7.1.20 | Neodox ® 25-11 | 0.00625 | Neodol ® 25-7 | 0.09375 | 0.438 |
| 7.1.21 | Neodox ® 25-11 | 0.00 | Neodol ® 25-7 | 0.010 | 0.977 |
| 7.1.22 | Neodox ® 25-11 | 0.075 | Plurafac ® D-25 | 0.025 | 0.376 |
| 7.1.23 | Neodox ® 25-11 | 0.0625 | Plurafac ® D-25 | 0.0375 | 0.392 |
| 7.1.24 | Neodox ® 25-11 | 0.05 | Plurafac ® D-25 | 0.05 | 0.381 |
| 7.1.25 | Neodox ® 25-11 | 0.0375 | Plurafac ® D-25 | 0.0625 | 0.402 |
| 7.1.26 | Neodox ® 25-11 | 0.025 | Plurafac ® D-25 | 0.075 | 0.435 |
| 7.1.27 | Neodox ® 25-11 | 0.00 | Plurafac ® D-25 | 0.10 | 0.811 |

25

TABLE 7.2

| | Conversion Coating before Treatment with LSCFC | | | | |
|---|---|---|---|---|---|
| | First Surfactant and Its Conc. | | Second Surfactant and Its Conc. | | Corresponding |
| # | Name | g/L | Name | g/L | COF Value |
| 7.2.1 | Neodox ® 25-11 | 0.10 | None | NA | 0.475 |
| 7.2.2 | Neodox ® 25-11 | 0.075 | Triton ® N-101 | 0.025 | 0.492 |
| 7.2.3 | Neodox ® 25-11 | 0.0625 | Triton ® N-101 | 0.0375 | 0.508 |
| 7.2.4 | Neodox ® 25-11 | 0.05 | Triton ® N-101 | 0.05 | 0.551 |
| 7.2.5 | Neodox ® 25-11 | 0.0375 | Triton ® N-101 | 0.0625 | 0.602 |
| 7.2.6 | Neodox ® 25-11 | 0.025 | Triton ® N-101 | 0.075 | 0.725 |
| 7.2.7 | Neodox ® 25-11 | 0.00 | Triton ® N-101 | 0.10 | 1.280 |
| 7.2.8 | Neodox ® 25-11 | 0.00625 | Neodol ® 25-7 | 0.09375 | 1.422 |
| 7.2.9 | Neodox ® 25-11 | 0.0125 | Neodol ® 25-7 | 0.0875 | 1.129 |
| 7.2.10 | Neodox ® 25-11 | 0.0375 | Neodol ® 25-7 | 0.0625 | 0.572 |
| 7.2.11 | Neodox ® 25-11 | 0.0125 | Neodol ® 25-7 | 0.0375 | 1.326 |
| 7.2.12 | Neodox ® 25-11 | 0.025 | Neodol ® 25-7 | 0.075 | 0.832 |
| 7.2.13 | Neodox ® 25-11 | 0.05 | Neodol ® 25-7 | 0.15 | 0.552 |
| 7.2.14 | Neodox ® 25-11 | 0.10 | Neodol ® 25-7 | 0.30 | 0.437 |
| 7.2.15 | Neodox ® 25-11 | 0.0375 | Plurafac ® D-25 | 0.0625 | 0.595 |
| 7.2.16 | None | NA | None | NA | 1.889 |

TABLE 7.3

| | No Conversion Coating before Treatment with LSCFC | | | | |
|---|---|---|---|---|---|
| | First Surfactant and Its Conc. | | Second Surfactant and Its Conc. | | Percent Water- |
| # | Name | g/L | Name | g/L | Break-Free |
| 7.3.1 | Neodox ® 25-11 | 0.025 | None | NA | 20.0 |
| 7.3.2 | Neodox ® 25-11 | 0.0375 | None | NA | 20.0 |
| 7.3.3 | Neodox ® 25-11 | 0.05 | None | NA | 20.0 |
| 7.3.4 | Neodox ® 25-11 | 0.0625 | None | NA | 30.0 |
| 7.3.5 | Neodox ® 25-11 | 0.075 | None | NA | 30.0 |
| 7.3.6 | Neodox ® 25-11 | 0.10 | None | NA | 40.0 |
| 7.3.7 | Neodox ® 25-11 | 0.075 | Triton ® N-101 | 0.025 | 40.0 |
| 7.3.8 | Neodox ® 25-11 | 0.0625 | Triton ® N-101 | 0.0375 | 50.0 |
| 7.3.9 | Neodox ® 25-11 | 0.05 | Triton ® N-101 | 0.05 | 80.0 |

TABLE 7.3-continued

| | No Conversion Coating before Treatment with LSCFC | | | | |
|---|---|---|---|---|---|
| | First Surfactant and Its Conc. | | Second Surfactant and Its Conc. | | Percent Water- |
| # | Name | g/L | Name | g/L | Break-Free |
| 7.3.10 | Neodox ® 25-11 | 0.0375 | Triton ® N-101 | 0.0625 | 98.0 |
| 7.3.11 | Neodox ® 25-11 | 0.025 | Triton ® N-101 | 0.075 | 100.0 |
| 7.3.12 | Neodox ® 25-11 | 0.00 | Triton ® N-101 | 0.10 | 100.0 |
| 7.3.13 | None | NA | None | NA | 100.0 |
| 7.3.14 | None | NA | None | NA | 1.500 |
| 7.3.15 | Neodox ® 25-11 | 0.075 | Neodol ® 25-7 | 0.025 | 60.0 |
| 7.3.16 | Neodox ® 25-11 | 0.0625 | Neodol ® 25-7 | 0.0375 | 75.0 |
| 7.3.17 | Neodox ® 25-11 | 0.05 | Neodol ® 25-7 | 0.05 | 85.0 |
| 7.3.18 | Neodox ® 25-11 | 0.0375 | Neodol ® 25-7 | 0.0625 | 98.0 |
| 7.3.19 | Neodox ® 25-11 | 0.025 | Neodol ® 25-7 | 0.075 | 100.0 |
| 7.3.20 | Neodox ® 25-11 | 0.0125 | Neodol ® 25-7 | 0.0875 | 100.0 |
| 7.3.21 | Neodox ® 25-11 | 0.00625 | Neodol ® 25-7 | 0.09375 | 100.0 |
| 7.3.22 | Neodox ® 25-11 | 0.00 | Neodol ® 25-7 | 0.010 | 100.0 |
| 7.3.23 | Neodox ® 25-11 | 0.075 | Plurafac ® D-25 | 0.025 | 60.0 |
| 7.3.24 | Neodox ® 25-11 | 0.0625 | Plurafac ® D-25 | 0.0375 | 70.0 |
| 7.3.25 | Neodox ® 25-11 | 0.05 | Plurafac ® D-25 | 0.05 | 80.0 |
| 7.3.26 | Neodox ® 25-11 | 0.0375 | Plurafac ® D-25 | 0.0625 | 95.0 |
| 7.3.27 | Neodox ® 25-11 | 0.025 | Plurafac ® D-25 | 0.075 | 99.0 |
| 7.3.28 | Neodox ® 25-11 | 0.00 | Plurafac ® D-25 | 0.10 | 100.0 |

The invention claimed is:

1. A liquid concentrate suitable for mixing with water to produce a liquid lubricant and surface conditioner forming composition, said concentrate comprising water and:

(A) an amount of a component selected from the group consisting of molecules of oxa acids and their methyl esters corresponding to general formula (I):

$$CH_3(CH_2)_nO(CH_2CH_2O)_xCH_2C(O)OR \quad (I),$$

where each of n and x, which may be the same or different, is a positive integer, x is not less than 8, and R represents H or $CH_3$; and (B) an amount of a component selected from the group consisting of:

(B.1) molecules corresponding to general formula (I) when x is not more than 7;

(B.2) molecules conforming to general formula (II):

$$R^1O(CH_2CH_2O)_y(CH_2CHCH_3O)_zH \quad (II),$$

where $R^1$ is a moiety selected from the group consisting of (i) saturated and unsaturated straight and branched chain aliphatic monovalent hydrocarbon moieties and (ii) saturated and unsaturated straight and branched chain aliphatic monovalent hydrocarbon moiety substituent bearing phenyl moieties in which the aromatic ring in the phenyl moiety is directly bonded to the oxygen atom appearing immediately after the $R^1$ symbol in formula (II); y is a positive integer, and z is zero, one, or two;

(B.3) molecules conforming to general formula (III):

$$R^2C(O)O(CH_2CH_2O)_pH \quad (III),$$

where $R^2$ is selected from the group consisting of saturated and unsaturated straight and branched chain aliphatic monovalent hydrocarbon moieties and p is a positive integer;

(B.4) molecules conforming to general formula (IV):

$$HO(CH_2CH_2O)_q(CH_2CHCH_3O)_r(CH_2CH_2O)_qH \quad (IV),$$

where each of q and q', which may be the same or different, represents a positive integer from 2 to 10 and r represents a positive integer from 3 to 60; and (B.5) molecules conforming to general formula (V):

$$HO(CH_2CHCH_3O)_s(CH_2CH_2O)_t(CH_2CHCH_3O)_sH \quad (V),$$

where each of s and s', which may be the same or different, represents a positive integer from 10 to 63 and t represents a positive integer from 2 to 20, wherein the amount of component (B) has a ratio to the amount of component (A) that is from about 0.2: 1.0 to about 10:1.0.

2. A concentrate according to claim 1, where: n is from 5 to 20; for component (A), x is from 9 to 25; for component (B), x is from 2 to 7; each of $R^1$ and $R^2$ contains from 8 to 22 carbon atoms; molecules conforming to general formulas (II) and (III) have an average HLB value from about 8.0 to about 19.5; each of q and q' is from 2 to 9; r is from 5 to 45; each of s and s' is from 15 to 55; t is from 3 to 18; and the ratio of the amount of component (B) to the amount of component (A) is from about 0.50:1.0 to about 9.0:1.0.

3. A concentrate according to claim 2, where: n is from 6 to 19; for component (A), x is from 10 to 25; for component (B), x is from 5 to 7; each of $R^1$ and $R^2$ contains from 10 to 21 carbon atoms; molecules conforming to general formulas (II) and (III) have an average HLB value from about 8.5 to about 18.9; each of q and q' is from 3 to 9; r is from 8 to 41; each: of s and s' is from 20 to 48; t is from 4 to 16; and the ratio of the amount of component (B) to the amount of component (A) is from about 0.70:1.0 to about 8.0:1.0.

4. A concentrate according to claim 3, where: n is from 7 to 18: for component (A), x is from 10 to 21;each of $R^1$ and $R^2$ contains from 11 to 20 carbon atoms; molecules conforming to general formulas (II) and (III) have an average HLB value from about 9.0 to about 18.6; each of q and q' is from 3 to 8; r is from 8 to 41; each of s and s' is from 20 to 48; t is from 4 to 16; and the ratio of the amount or component (B) to the amount of component (A) is from about 0.90:1.0 to about 7.0:1.0.

5. A concentrate according to claim 4, where: n is from 8 to 17; for component (A), x is from 10 to 19; each of $R^1$ and $R^2$ contains from 12 to 19 carbon atoms; molecules conforming to general formulas (II) and (III) have an average HLB value from about 9.5 to about 18.3; each of q and q' is from 3 to 7; r is from 16 to 36; each of s and s' is from 22 to 42; t is from 5 to 14; and the ratio of the amount of component (B) to the amount of component (A) is from about 1.10:1.0 to about 6.5:1.0.

6. A concentrate according to claim 5, where: n is from 9 to 16; for component (A), x is from 10 to 17; each of q and q' is from 3 to 8; r is from 20 to 34; each of s and s' is from 22 to 37; t is from 5 to 12; and the ratio of the amount of component (B) to the amount of component (A) is from about 1.30:1.0 to about 6.5:1.0.

7. A concentrate according to claim 6, where: n is from 10 to 15; for component (A), x is from 10 to 15; each of q and q' is from 3 to 5; r is from 24 to 34; each of s and s' is from 24 to 33; t is from 5 to 10; and the ratio of the amount of component (B) to the amount of component (A) is from about 2.0:1.0 to about 6.5:1.0.

8. A concentrate according to claim 7, where: r is from 26 to 32; each of s and s' is from 24 to 30; t is from 5 to 8; and the ratio of the amount of component (B) to the amount of component (A) is from about 2.5:1.0 to about 6.0:1.0.

9. A concentrate according to claim 8, wherein is from 11 to 14; for component (A), x is from 11 to 12; each of q and q' is from 3 to 4; r is from 28 to 30; each of s and s' is from 26 to 28; t is from 6 to 7; and the ratio of the amount of component (B) to the amount of component (A) is from about 3.0:1.0 to about 4.5:1.0.

10. A concentrate according to claim 9, where each of $R^1$ and $R^2$ has from 14 to 18 carbon atoms, is unsaturated, and is straight chain, optionally with a single methyl substituent, and the ratio of the amount of component (B) to the amount of component (A) is from about 3.5:1.0 to about 4.0:1.0.

11. A process for cleaning and decorating aluminum cans, wherein the cans are cleaned, then optionally conversion coated, subsequently contacted with an aqueous lubricant and surface conditioner forming composition effective to cause the thus-treated cans to have a coefficient of static friction on their exterior sidewalls after drying that is less than 1.0, and then decorated by labeling or printing or both labeling and printing, wherein the improvement comprises contacting the cans with an aqueous lubricant and surface conditioned forming composition that comprises water and:

(A) an amount from about 0.004 to about 1.0 g/L of a component selected from the group consisting of molecules of oxa acids and their methyl esters corresponding to general formula (I):

$$CH_3(CH_2)_nO(CH_2CH_2O)_xCH_2C(O)OR \quad (I),$$

where each of n and x, which may be the same or different, is a positive integer, x is not lass than 8, and R represents H or $CH_3$; and (B) an amount of a component selected from the group consisting of:

(B.1) molecules corresponding to general formula (I) when x is not more than 7;

(B.2) molecules conforming to general formula (II):

$$R^1O(CH_2CH_2O)_y(CH_2CHCH_3O)_zH \quad (II),$$

where $R^1$ is a moiety selected from the group consisting of (i) saturated and unsaturated straight and branched chain aliphatic monovalent hydrocarbon moieties and (ii) saturated and unsaturated straight and branched chain aliphatic monovalent hydrocarbon moiety substituent bearing phenyl moieties in which to aromatic ring in the phenyl moiety is directly bonded to the oxygen atom appearing immediately after the $R^1$ symbol in formula (II); y is a positive integer; and z is zero, one, or two;

(B.3) molecules conforming to general formula (III):

$$R^2C(O)O(CH_2CH_2O)_pH \quad (III),$$

where $R^2$ is selected from the group consisting of saturated and unsaturated straight and branched chain aliphatic monovalent hydrocarbon moieties and p is a positive integer;

(B.4) molecules conforming to general formula (IV):

$$HO(CH_2CH_2O)_q(CH_2CHCH_3O)_r(CH_2CH_2O)_qH \quad (IV),$$

where each of q and q', which may be the same or different represents a positive integer from 2 to 10 and r represents a positive integer from 3 to 80; and (B.5) molecules conforming to general formula (V):

$$HO(CH_2CHCH_3O)_s(CH_2CH_2O)_t(CH_2CHCH_3O)_sH \quad (V),$$

where each of s and s', which may be the same or different, represents a positive integer from 10 to 63 and t represents a positive integer from 2 to 20, wherein the amount of component (B) has a ratio to the amount of component (A) that is from about 0.2:1.0 to about 10:1.0.

12. A process according to claim 11, where: the amount of component (A) are the amount of component (B) have a sum that is from about 0.010 to about 0.090 g/L; n is from 5 to 20; for component (A), x is from 9 to 25; for component (B), x is from 2 to 7; each of $R^1$ and $R^2$ contains from 8 to 22 carbon atoms; molecules conforming to general formulas (II) and (III) have an average HLB value from about 8.0 to about 19.5; each of q and q' is from 2 to 9; r is from 5 to 45; each of s and s' is from 15 to 55; t is from 3 to 18; and the ratio of the amount of component (B) to the amount of component (A) is from about 0.50:1.0 to about 9.0:1.0.

13. A process according to claim 12, where: the sum of the amounts of components (A) and (B) is from about 0.020 to about 0.90 g/L; n is from 6 to 19; for component (A), x is from 10 to 25; for component (B), x is from 5 to 7; each of $R^1$ and $R^2$ contains from 10 to 21 carbon atoms; molecules conforming to general formulas (II) and (Ill) have an average HLB value from about 8.5 to about 18.9; each of q and q' is from 3 to 9; r is from 8 to 41; each of s and s' is from 20 to 48; t is from 4 to 16; and the ratio of the amount of component (B) to the amount of component (A) is from about 0.70:1.0 to about 8.0:1.0.

14. A process according to claim 13, where: the sum of the amounts of components (A) and (B) is from about 0.030 to about 0.80 g/L; n is from 7 to 18; for component (A), x is from 10 to 21; each of $R^1$ and $R^2$ contains from 11 to 20 carbon atoms; molecules conforming to general formulas (II) and (III) have an average HLB value from about 9.0 to about 18.6; each of q and q' is from 3 to 8; r is from 8 to 41;

ea-s of s and s' is from 20 to 48; t is from 4 to 16; and the ratio of the amount of component (B) to the amount of component (A) is from about 0.90:1.0 to about 7.0:1.0.

15. A process according to claim 14, where the sum of the amounts of components (A) and (B) is from about 0.040 to about 0.70 g/L; n is from 8 to 17; for component (A), x is from 10 to 19; each of $R^1$ and $R^2$ contains from 12 to 19 carbon atoms; molecules conforming to general formulas (II) and (lII) have an average HLB value from about 9.5 to about 18.3; each of q and q' is from 3 to 7; r is from 16 to 36; each of s and s' is from 22 to 42; t is from 5 to 14; and the ratio of the amount of component (B) to the amount of component (A) is from about 1.10:1.0 to about 8.5:1.0.

16. A process according to claim 15, where: the sum of the amounts of components (A) and (B) is from about 0.048 to about 0.60 g/L; n is from 9 to 16; for component (A), x is from 10 to 17; each of q and q' is from 3 to 6; r is from 20 to 34; each of s and s' is from 22 to 37; t is from 5 to 12; and the ratio of the amount of component (B) to the amount of component (A) is from about 1.30:1.0 to about 6.5:1.0.

17. A process according to claim 16, where: the sum of the amounts of components (A) and (B) is from about 0.052 to about 0.50 g/L; n is from 10 to 15; for component (A), x is from 10 to 15; each of q and q' is from 3 to 5; r is from 24 to 34; each of s and s' is from 24 to 33; t is from 5 to 10; and the ratio of the amount of component (B) to the amount of component (A) is from about 2.0:1.0.to about 6.5:1.0.

18. A process according to claim 17, where: the sum of the amounts of components (A) and (B) is from about 0.068 to about 0.35 g/L; r is from 26 to 32; each of s and s' is from 24 to 30; t is from 5 to 8; and the ratio of the amount of component (B) to the amount of component (A) is from about 2.5:1.0 to about 6.0:1.0.

19. A process according to claim 18, where: the sum of the amounts of components (A) and (B) is from about 0.080 to about 0.25 g/L; n is from 11 to 14; for component (A), x is from 11 to 12; each of q and q' is from 3 to 4; r is from 28 to 30; each of s and s' is from 26 to 28; t is from 6 to 7; and the ratio of the amount of component (B) to the amount of component (A) is from about 3.0:1.0 to about 4.5:1.0.

20. A process according to claim 19, where: the sum of the amounts of components (A) and (B) is from about 0.096 to about 0.17 g/L; each of $R^1$ and $R^2$ has from 14 to 18 carbon atoms, is unsaturated, and is straight chain, optionally with a single methyl substituent; and the ratio of the amount of component (B) to the amount of component (A) is from about 3.5:1.0 to about 4.0:1.0.

* * * * *

UNITED STATES PATENT AND TRADEMARK OFFICE

CERTIFICATE OF CORRECTION

PATENT NO. : 6,040,280
DATED : March 21, 2000
INVENTOR(S) : Kelly et al.

It is certified that error appears in the above-identified patent and that said Letters Patent is hereby corrected as shown below:

Title page,
Item [57], ABSTRACT,
Line 11, delete formula (I) and insert -- $CH_3(CH_2)_nO(CH_2CH_2O)_xCH_2C(O)OR$ --.

Column 23,
Line 56, after "integer", delete "," and insert -- ; --.

Column 24,
Line 27, delete formula (IV) and insert
-- $HO(CH_2CH_2O)_q(CH_2CHCH_3O)_r(CH_2CH_2O)_{q'}H$ --.
Line 35, delete formula (V) and insert
-- $HO(CH_2CHCH_3O)_s(CH_2CH_2O)_t(CH_2CHCH_3O)_{s'}H$ --.
Line 58, after "each", delete ":".
Line 62, after "18" insert -- ; --;
Line 67, delete "or" and insert -- of --.

Column 25,
Line 14, delete "8", and insert -- 6 --.
Line 28, delete "wherein", and insert -- where: n --.
Line 48, delete "conditioned", and insert -- conditioner --.
Line 58, delete "lass", and insert -- less --.

Column 26,
Line 7, after "which", delete "to", and insert -- the --.
Line 24, delete formula (IV) and insert
-- $HO(CH_2CH_2O)_q(CH_2CHCH_3O)_r(CH_2CH_2O)_{q'}H$ --.
Line 28, delete "80", and insert -- 60 --.
Line 32, delete formula (V) and insert
-- $HO(CH_2CHCH_3O)_s(CH_2CH_2O)_t(CH_2CHCH_3O)_{s'}H$ --.
Line 40, delete "are" and insert -- and --.
Line 41, delete "0.090" and insert -- 0.90 --.

Column 27,
Line 1, delete "ea-s" and insert -- each --.
Line 4, after "where", insert -- : --.

UNITED STATES PATENT AND TRADEMARK OFFICE

CERTIFICATE OF CORRECTION

PATENT NO. : 6,040,280
DATED : March 21, 2000
INVENTOR(S) : Kelly et al.

It is certified that error appears in the above-identified patent and that said Letters Patent is hereby corrected as shown below:

Column 28,
Line 2, after "1.0", delete ".".

Signed and Sealed this

Twenty-eighth Day of February, 2006

JON W. DUDAS
*Director of the United States Patent and Trademark Office*